US005534140A

United States Patent [19]

Brummond et al.

[11] Patent Number: 5,534,140

[45] Date of Patent: Jul. 9, 1996

[54] BAR SCREEN HAVING COMPOUND FINE SCREEN BAR RACK

[75] Inventors: Robert A. Brummond; Roger Scheel; James L. Heidner, all of Waukesha, Wis.

[73] Assignee: Envirex, Inc., Waukesha, Wis.

[21] Appl. No.: 210,312

[22] Filed: Mar. 17, 1994

[51] Int. Cl.[6] ..... B01D 39/10

[52] U.S. Cl. ..... 210/106; 210/155; 210/159; 210/162; 210/357

[58] Field of Search ..... 210/155, 159, 210/160, 162, 106, 107, 408, 357

[56] References Cited

U.S. PATENT DOCUMENTS

| | | | |
|---|---|---|---|
| 1,717,313 | 6/1929 | D'Olier . | |
| 1,874,126 | 8/1932 | Schofield et al. | 210/155 |
| 1,877,449 | 9/1932 | Fulcher | 210/357 |
| 2,106,851 | 2/1938 | Nordell | 210/152 |
| 2,271,662 | 2/1942 | Rubissow | 210/169 |
| 2,671,563 | 3/1954 | Benner, Jr. | 210/176 |
| 2,897,967 | 8/1959 | Arthur | 210/173 |
| 2,996,189 | 8/1961 | Salterbach | 210/155 |
| 3,037,630 | 6/1962 | Bixby | 209/393 |
| 3,169,111 | 2/1965 | Rose et al. | 210/247 |
| 3,716,144 | 2/1973 | Bartlow | 210/499 |
| 3,850,804 | 11/1974 | Taylor et al. | 210/155 |
| 3,934,521 | 1/1976 | Andreoli | 110/15 |
| 4,042,506 | 8/1977 | Wilson | 210/155 |
| 4,107,040 | 8/1978 | Rudolph et al. | 210/159 |
| 4,184,957 | 1/1980 | Botsch | 210/155 |
| 4,229,301 | 10/1980 | Roberts | 210/159 |
| 4,265,750 | 5/1981 | Meunier | 210/159 |
| 4,447,323 | 5/1984 | Jackson | 210/158 |
| 4,472,273 | 9/1984 | Hagihara | 210/159 |
| 4,521,306 | 6/1985 | Day | 210/159 |
| 4,561,975 | 12/1985 | Schloss, Jr. | 210/155 |
| 4,851,114 | 7/1989 | Minichello | 210/143 |
| 4,921,599 | 5/1990 | Botsch | 210/155 |
| 5,032,262 | 7/1991 | Wallander | 210/154 |
| 5,032,263 | 7/1991 | Rudzinski | 210/159 |
| 5,051,174 | 9/1991 | Nungaray | 210/159 |
| 5,098,561 | 3/1991 | Grabbe | 210/155 |
| 5,167,803 | 12/1992 | Newton et al. | 210/141 |
| 5,171,436 | 12/1992 | Botsch | 210/159 |
| 5,277,799 | 1/1994 | Bransch | 210/155 |

*Primary Examiner*—Peter A. Hruskoci
*Assistant Examiner*—Theodore M. Green
*Attorney, Agent, or Firm*—Michael, Best & Friedrich

[57] ABSTRACT

A bar screen for screening a flow of wastewater, the bar screen comprising a frame, a first bar rack supported by the frame and extending across the flow of wastewater, the first bar rack including a plurality of generally parallel, elongated first bars each having a top end and a bottom end, the plurality of first bars defining therebetween a plurality of upstream spaces, a first bar rack top support engaged with the top end of each first bar and a first bar rack bottom support engaged with the bottom end of each first bar, a second bar rack supported by the frame and extending across the flow of wastewater, the second bar rack including a plurality of generally parallel, elongated second bars each having a top end and a bottom end, a second bar rack top support engaged with the top end of each second bar and a second bar rack bottom support engaged with the bottom end of each second bar, the second bar rack bottom support overlying a portion of the first bar rack bottom support, and a mounting arrangement for fixing the first bar rack to the frame and for releasably mounting the second bar rack on the frame, the first and second bar racks thereby defining a fine screen compound bar rack wherein the second bars have a portion extending into a respective upstream space.

27 Claims, 6 Drawing Sheets

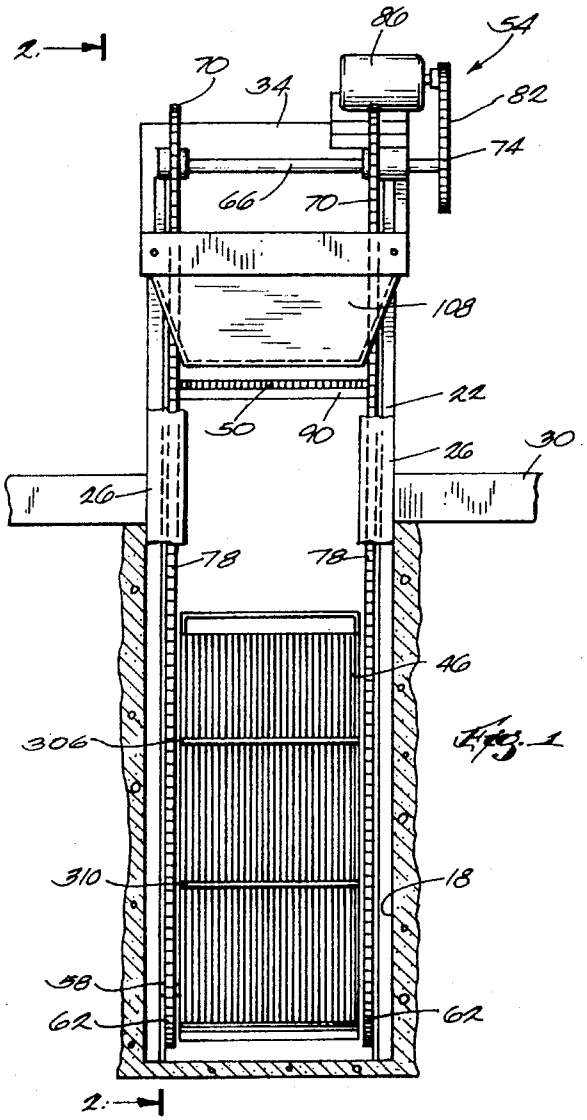
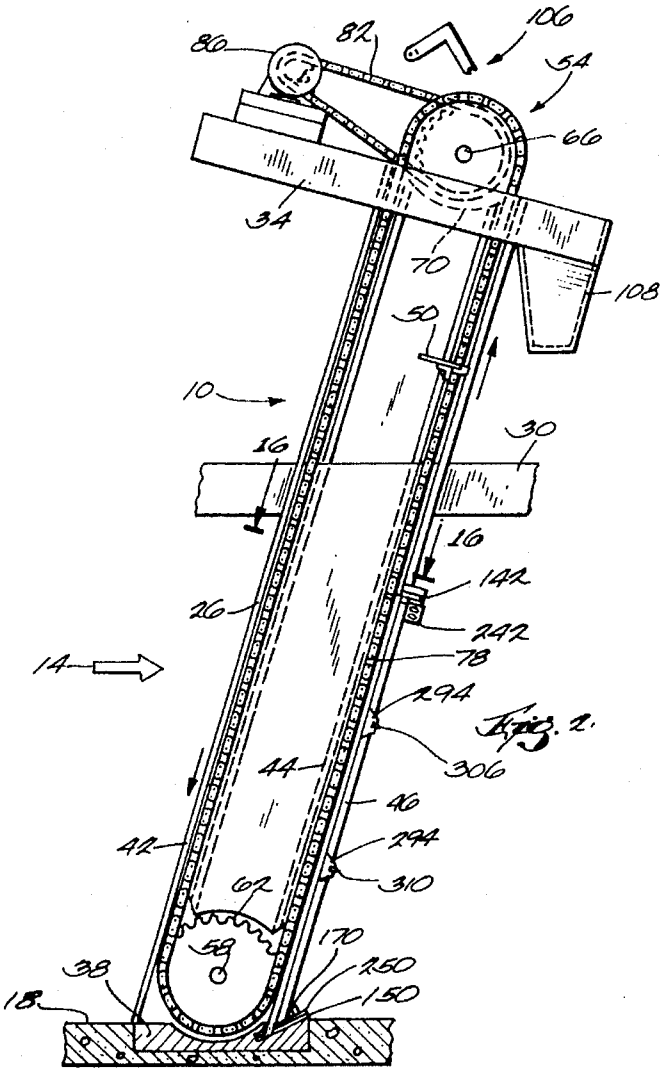

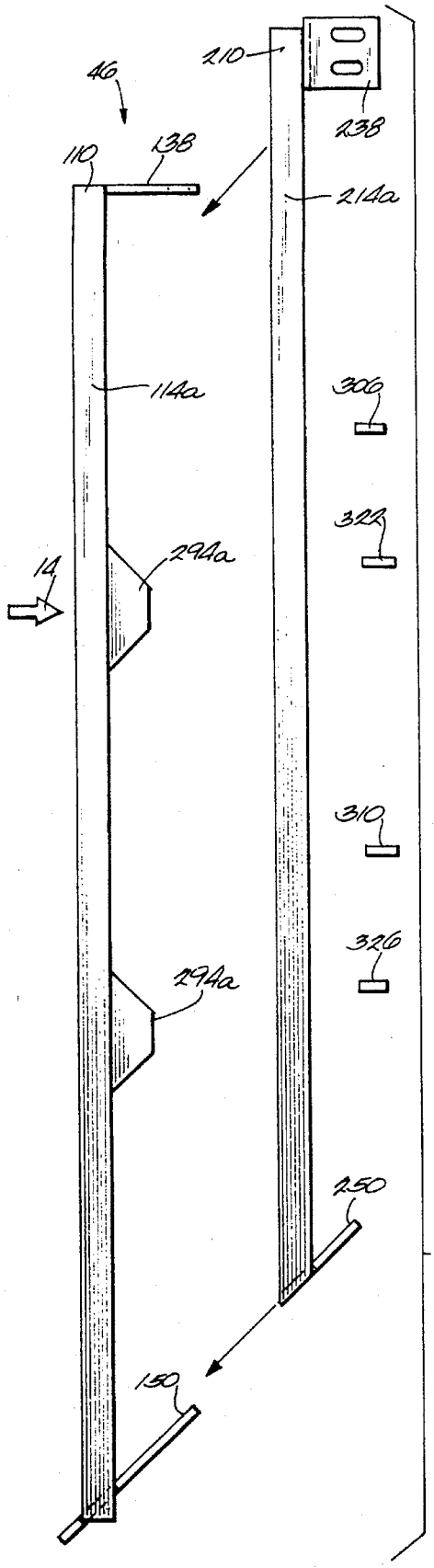
Fig. 6
Fig. 15
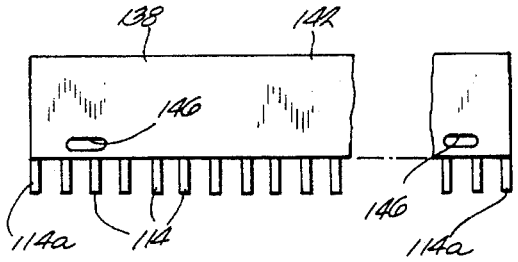
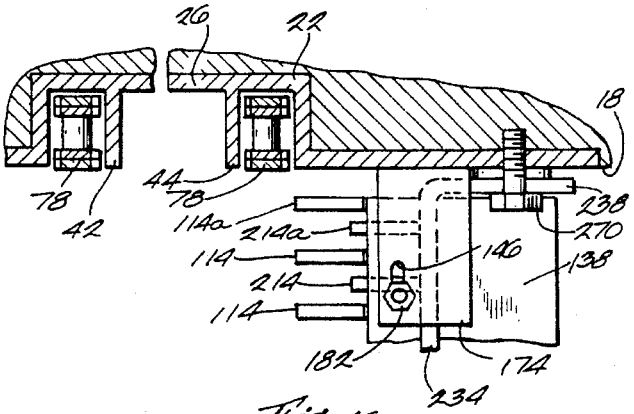
Fig. 16

BAR SCREEN HAVING COMPOUND FINE SCREEN BAR RACK

BACKGROUND OF THE INVENTION

1. Technical Field

The invention relates to bar screens for screening a flow of wastewater, and more particularly to bar screens having a bar rack.

2. Related Prior Art

The processing of wastewater in industrial or municipal wastewater treatment plants or pumping stations commonly includes the use of a bar screen located in a channel conducting a flow of wastewater. Bar screens remove various sizes of solid waste carried by the wastewater so that such solids do not damage or otherwise compromise the operation of equipment or processes located downstream of the bar screens. One type of bar screen for performing such waste removal includes a bar rack, which is an array of spaced-apart bars that extends across the flow of wastewater.

Bar racks fall into one of three general classifications: trash racks, coarse screen bar racks, and fine screen bar racks. A trash rack has an effective screen opening between bars of approximately 1-½" to 4.0" and a coarse screen bar rack has an effective screen opening of approximately ⅜" to 1-½". A fine screen bar rack has an effective screen opening of less than approximately ⅜". A fine screen bar rack can be used to remove fibers and other relatively small sized waste objects which are carried by a flow of wastewater and which otherwise might pass through a coarse bar rack.

While it is important that bar screens remove large floating or suspended solids which might present difficulty for the processing of the wastewater, it is at the same time important to allow smaller solids to pass through the screen to be treated in normal wastewater processing. Accordingly, the selection of an appropriate bar rack for a bar screen will depend largely on the operating environment of the bar screen and on the processing equipment located downstream of the bar screen.

Examples of various prior art bar screens which include bar racks are illustrated in Vol. 1 of *Envirex Water and Wastewater Treatment Equipment*, (Binder 315), published by Envirex, Inc., 1901 South Prairie Avenue, Waukesha, Wis. 53186-7360. An example of a fine screen bar rack is disclosed by U.S. Pat. No. 4,184,957, which issued to Botsch on Jan. 22, 1980.

Bar screens also typically include mechanical apparatus for cleaning the bar rack and for removing waste collected by the bar rack. Such mechanical apparatus can include a cleaning rake that is supported by the bar screen for movement along the bar rack. It is important to the effective operation of a bar screen, and to the overall performance of the wastewater treatment process, that the solids collected by a bar rack be removed. A broken or ineffective cleaning rake can adversely affect the performance of such processes.

The above-identified Envirex publication illustrates bar screens equipped with cleaning rakes for cleaning associated bar racks. Also, U.S. Pat. No. 4,184,957, which issued to Botsch on Jan. 22, 1980, illustrates a bar screen including a bar rack and a cleaning rake for removing screenings from the bar rack.

SUMMARY OF THE INVENTION

The invention provides a bar screen including a fine screen compound bar rack for screening a flow of wastewater. The fine screen compound bar rack includes a first bar rack extending across the flow of wastewater and a second bar rack extending across the flow of water immediately downstream of the first bar rack. The bar screen also includes means for independently supporting the first and second bar racks so that a course screen bar rack can be fitted with a second bar rack to provide a compound fine screen bar rack. Such a retrofit application of a second bar rack to an existing bar screen affords the economical conversion of a coarse bar screen into a fine bar screen.

According to one aspect, the invention comprises a bar screen for screening a flow of wastewater, the bar screen including a frame, a first bar rack supported by the frame, and a second bar rack supported by the frame. The first bar rack includes a plurality of generally parallel, vertically extending elongated first bars defining therebetween a plurality of upstream spaces. A first top support engages the top ends of the first bars and a first bottom support engages the bottom ends of the first bars.

The second bar rack also includes a plurality of generally parallel, vertically extending, elongated second bars. A second top support engages the top ends of the second bars and a second bottom support engages the bottom ends of the second bars. The second bar rack bottom support overlies a portion of the first bar rack bottom support. The bar screen also includes mounting means for fixing the first bar rack to the frame and for releasably mounting the second bar rack on the frame, so that the first and second bar racks define a fine screen compound bar rack.

One feature of the invention is the provision of a compound bar rack wherein the second bar rack is movable relative to the first bar rack under extreme flow conditions. The second bar rack is hingedly connected at its lower end to the frame of the bar screen, and is releasably connected at its upper end to the frame of the bar screen. Should the pressure exerted on the compound bar rack by the flow of wastewater exceed a predetermined threshold pressure, the second bar rack pivots rearwardly away from the first bar rack. The rearward pivotal movement of the second bar rack effectively converts the fine screen bar rack to a coarse bar rack by increasing the effective screen opening of the compound bar rack. As a result, the volumetric flow of wastewater through the compound bar rack can be increased and the pressure exerted on the bar rack is diminished. After the flow of wastewater through the bar rack subsides to a normal level of flow, the second bar rack can be reset by pivoting the second bar rack forwardly toward its upright position adjacent the first bar rack. The releasable connection between the frame and the upper end of the second bar rack can then be reestablished to define a fine screen compound bar rack.

Another feature of the invention is the provision of a bar screen including a cleaning rake which is movable along a fine screen compound bar rack to remove matter collected by the bar rack. In one embodiment, the cleaning rake has a plurality of fingers which extend into the spaces between the bars of the compound bar rack to remove solids captured by the bars. The fingers of the cleaning rake have short prongs that extend to either side of the bars of the second, or downstream, bar rack. Also, the first and second bars of the first and second bar racks are fixed at one end and are supported so that the remaining portions of the first and second bars can be slightly displaced laterally. For example, should any misalignment between the cleaning rake and the bars of the bar racks occur, the fingers of the cleaning rake can move the first and second bars laterally as the rake travels along the compound bar rack. As a result, the fingers of the cleaning rake are less likely to become jammed or broken during operation of the cleaning rake.

Another feature of the invention is the provision of a compound fine screen bar rack having a construction which affords the retrofit of a coarse bar screen with a second bar rack so as to form a fine screen.

Another feature of the invention is the provision of a bar screen including a fine screen compound bar rack and a cleaning rake having fingers which are resistant to breakage.

Various other features and advantages of the invention will become apparent to those skilled in the art upon review of the following detailed description, claims and drawings.

BRIEF DESCRIPTION OF THE DRAWINGS

FIG. 1 is an elevational view of a bar screen embodying the invention.

FIG. 2 is an elevational view taken along line 2—2 in FIG. 1.

FIG. 6 is an exploded view of the bar rack included in the bar screen illustrated by FIG. 1.

FIG. 15 is a view taken along line 15—15 in FIG. 9.

FIG. 16 is an enlarged view of a portion of the bar screen illustrated in FIG. 2 and is taken generally along line 16—16 in FIG. 2.

Figure 5:
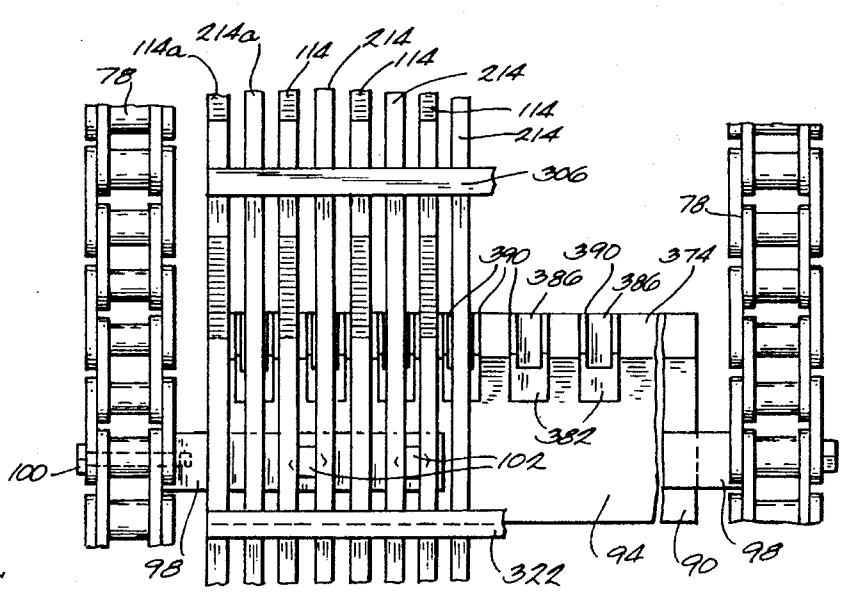
FIG. 5 is a view taken generally along line 5—5 in FIG. 3.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A bar screen 10, which is a first embodiment of the invention, is illustrated in FIGS. 1–16. Referring first to FIGS. 1 and 2, the bar screen 10 is used for screening a flow 14 (shown schematically) of wastewater conducted through a channel 18. The bar screen 10 includes (FIG. 1) a frame 22 having a pair of side members 26 located within respective opposite walls of the channel 18 and extending upwardly outwardly of the channel 18 past a service floor 30. The upper ends of the side members 26 support a raised platform 34 and, as best shown in FIG. 2, the lower ends of the side members 26 are connected by a base 38. Each side member 26 has a pair of chain guides 42, 44 which open inwardly of the channel 18. As discussed more particularly below, one of the chain guides 42 is a downward run and the other chain guide 44 is an upward run.

The bar screen 10 illustrated by FIG. 1 also includes a fine screen compound bar rack 46 extending between the side members 26 of the frame 22. The fine screen compound bar rack 46 also extends across the channel 18 and, accordingly, across the flow 14 of wastewater. The bar screen 10 also includes a cleaning rake 50 for removing solids collected by the fine screen compound bar rack 46, and a rake drive 54 for moving the cleaning rake 50.

The rake drive 54 includes (FIG. 2) a foot shaft 58 supported by the side members 26 adjacent the base 38 of the frame 22 and a pair of foot sprockets 62 (one shown in FIG. 2) fixed to the opposite ends of the foot shaft 58. The rake drive 54 also includes a head shaft 66 supported by the side members 26 above the platform 34, and a pair of head sprockets 70 (one shown in FIG. 2) and a driven sprocket 74, each of which are fixed to the head shaft 66. The rake drive 54 also includes a pair of endless chains 78 (only one shown in FIG. 2) which are housed within the chain guides 42, 44 of a respective side member 26 and which are engaged with a head sprocket 70 and a foot sprocket 62. The driven sprocket 74 is drivingly engaged by an endless drive chain 82 which is driven in turn by a motor 86 located on the platform 34.

The rake drive 54 also includes (FIG. 1) a rake support 90 which is carried by the chains 78 and which, in turn, carries the cleaning rake 50. Referring to FIG. 2, the rake support 90 and the cleaning rake 50 carried thereby travel downwardly along the upstream chain guide 42, about the foot shaft 58, upwardly along the downstream chain guide 44, past the fine screen compound bar rack 46, and about the head shaft 66. As shown in detail in FIG. 5, the rake support 90 includes an angle bracket 94 having opposite ends adjacent the chains 78. A pair of rake support brackets 98 (see FIG. 5) are fixed to respective ends of the rake support 90 and to the chains 78. In particular, and with reference to FIGS. 4 and 5, each rake support bracket 98 is fixed to a link of one of the chains 78 by a pin 100, and is fixed to an end of the angle bracket 94 by a pair of nut/bolt assemblies 102.

The bar screen 10 also includes (FIG. 2) a rake wiper assembly 106 located above the platform 34 for removing collected solids from the cleaning rake 50. A discharge chute 108 on the platform 34 collects solids removed from the cleaning rake 50 by the wiper assembly 106.

Figure 7:
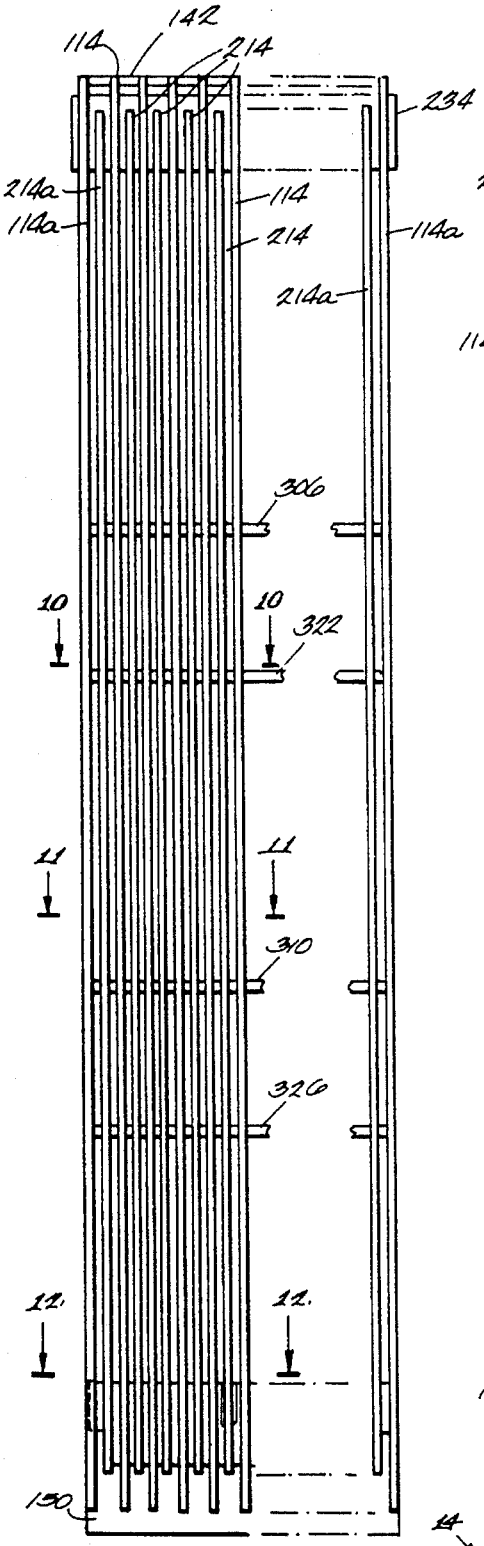
FIG. 7 is a front elevational view of the bar rack illustrated in FIG. 6.
Figure 8:
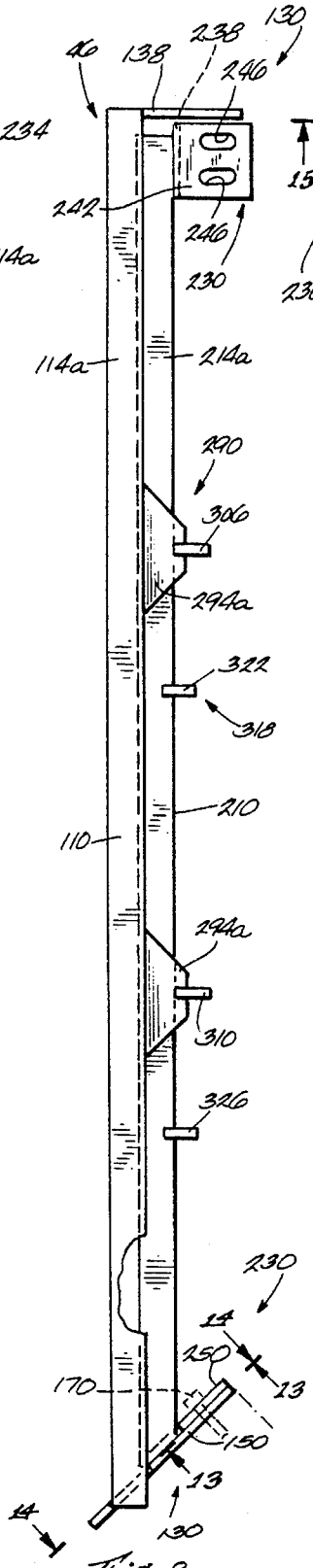
FIG. 8 is a side view of the bar rack illustrated in FIG. 7.
Figure 9:
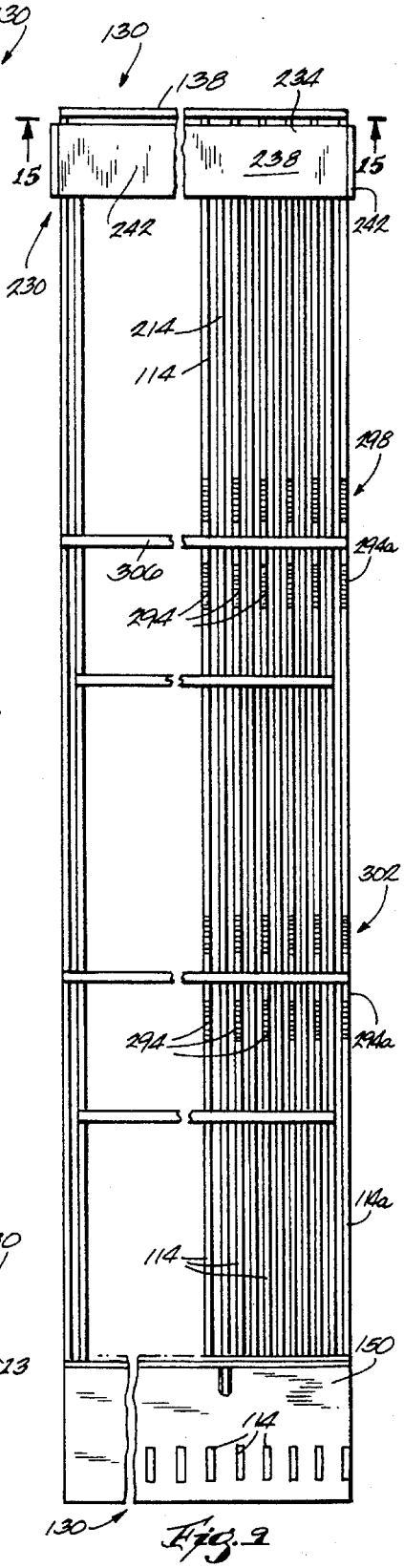
FIG. 9 is a rear view of the bar rack illustrated in FIG. 7.

More particularly, and with initial reference to FIG. 6, the fine screen compound bar rack 46 includes a first bar rack 110 and a second bar rack 210. The first bar rack 110 provides a plurality of elongated first bars 114. The second bar rack 210 is located immediately downstream of the first bar rack 210 and provides a plurality of elongated second bars 214. FIG. 6 shows the first and second bar racks 110, 210 in spaced-apart relation and illustrates the separability of the first and second bar racks 110, 210. FIG. 8 illustrates the fine screen compound bar rack 46 in a position wherein the first and second bar racks 110, 210 are in closely spaced, mated relation. When so closely spaced, and as shown in FIGS. 7 and 8, the first bars 110 and the second bars 210 mesh.

Figure 10:
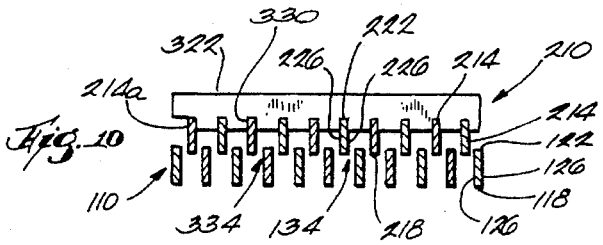
FIG. 10 is a cross-sectional view taken along line 10—10 in FIG. 7.

Referring to FIG. 10, each first bar 114 of the first bar rack 110 has a generally rectangular cross-section when viewed in a plane extending perpendicular to the length of the first bar 114. Each first bar 110 has an upstream face 118, a downstream face 122, and a pair of opposite facing side faces 126. The side faces 126 have a greater extent or surface area than the upstream or downstream faces 118, 122 so that each first bar 114 has a width, i.e., an extent across the flow 14 of wastewater, less than its depth i.e., an extent in the direction of the flow 14. The first bars 114 are held in spaced relation in a manner discussed below so as to define therebetween a plurality of upstream spaces 134. The side faces 126 of the first bars 114 are spaced apart so that the upstream spaces 134 are approximately ⅞" wide.

Referring now to FIG. 8, the first bar rack 110 also includes means 130 located at the ends of the first bars 114 for supporting the first bars 114 in generally parallel, spaced-apart relation. In particular, the first bar support means 130 includes a first bar top support 138. The first bar top support 138 includes (FIG. 15) a plate 142 which is fixed, preferably by welding, to the rearward face 122 of each of the first bars 114 adjacent the top end. For reasons discussed below, the first bar top support 138 has therein a pair of slots 146 respectively located adjacent the opposite ends of the plate 142.

Figure 14:
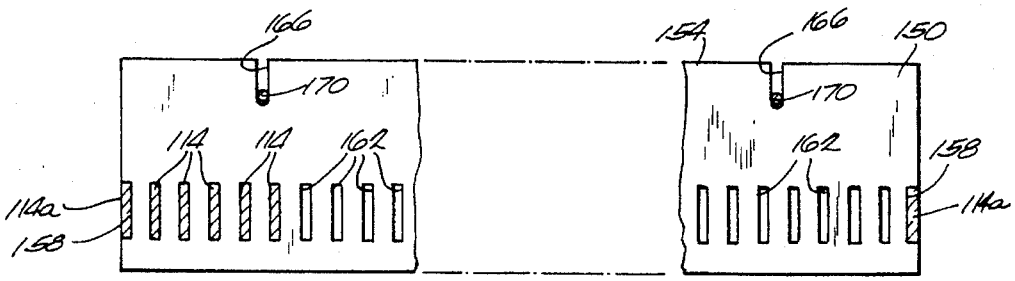
FIG. 14 is a view taken along line 14—14 in FIG. 8.

The means 130 for supporting the first bars 114 also includes (FIG. 8) a first bar bottom support 150. The first bar bottom support 150 includes (FIG. 14) a laterally extending plate 154 having a pair of recesses 158 located in respective opposite ends of the plate 154 and having therein a plurality of slots 162 extending in a row between the opposite ends. The bottom end of each of the first bars 114 is received in one of either the recesses 158 or slots 162. However, the bottom ends of only the outermost first bars (identified by reference numeral 114*a*) received by the recesses 158 are fixed, preferably by welding, to the plate 154. The remainder of the bottom ends of the first bars 114 are held in position by, but are not fixed to, the slots 162 in the first bar bottom support 150. Preferably, and for reasons discussed below, the slots 162 are appropriately sized so that the first bars 114 received in the slots 162 are deflectable slightly laterally within the slots 162. As shown in FIG. 14, the first bar bottom support plate 154 also has therein a pair of fastener slots 166. A bottom plate fastener 170 is received by the slots 166 and, as shown in FIG. 2, fixes the first bar bottom support 150 to the base 38 of the frame 22.

The upper end of the first bar rack 110 is also fixed to the frame 22. In particular, the frame 22 includes (FIG. 16) a pair of first bar rack support brackets 174 (one shown in FIG. 16) fixed to the downstream face of each side member 26. Each first bar rack support bracket 174 extends inwardly of the channel 18 and overlies an end of the first bar top support 138. Each first bar support bracket 174 has therein a bolt hole (not shown) which registers with the fastener slot 146 adjacent an end of the first bar top support 138, and is connected thereto by a bolt 182.

Referring now to FIG. 10 and the details of the second bar rack 210, each second bar 214 has a generally rectangular cross-section when viewed in a plane extending perpendicular to the length of the second bar 214. Each second bar 214 also has a forward or upstream face 218, a rearward or downstream face 222, and a pair of opposite facing side faces 226. The extent of the side faces 226 is greater than the extent of the upstream or downstream faces 218, 222 so that each second bar 214 has a width less than its depth.

The second bars 214 are arranged in closely spaced relation with the first bars 114 to form the fine screen compound bar rack 46. In particular, the second bars 214 align with the upstream spaces 134 between the first bars 114. A portion of each of the second bars 214 extends into a respective upstream space 134 so that the side faces 226 of the second bar 214 and the side faces 126 of adjacent first bars 114 define therebetween a downstream space 334 which communicates with an upstream space 134. Preferably, the downstream spaces 334 have a width of approximately a ¼", i.e., the opposed portions of the side faces 126, 226 of the first bars 114 and the second bars 214 are spaced-apart approximately ¼".

The second bar rack 210 also includes (FIG. 8) means 230 located at the ends of the second bars 114 for supporting the second bars 214 in generally parallel, spaced-apart relation. In particular, the second bar support means 230 includes a second bar top support 234 that is fixed to the top ends of each of the second bars 214. The second bar top support 234 includes (FIG. 9) a plate 238 that extends laterally across the channel 18 and that is fixed, preferably by welding, to the rearward face of each of the second bars 214. For reasons discussed below, and as shown in FIG. 8, each of the opposite ends 242 of the second bar top support 234 extend downstream, and have therein a pair of fastener slots 246.

The second bar supporting means 230 also includes (FIG. 8) a second bar bottom support 250 that overlies a portion of the first bar bottom support 150. In particular, the second bar bottom support 250 includes (FIG. 13) a plate 254 that has therein a plurality of forwardly opening slots 258 and a pair of recesses 262 in respective opposite ends of the plate 254. The bottom end of each second bar 214 is received by one of either the slots 258 or the recesses 262 in the plate 254. Similar to the engagement between the first bars 114 and the first bar bottom support plate 154, the second bars 214 are supported by the second bar bottom support 250 so that only the outermost second bars (identified by reference numeral 214*a*) are fixed, preferably by welding, to the second bar bottom support 250, and the remainder of the second bars 214 are held in place by, and are slightly deflectable laterally within, the slots 258. The second bar bottom support plate 254 also includes a pair of rearwardly opening fastener slots 266 for receiving the fastener 170.

The second bar bottom support 250 is fixed, as shown in FIG. 2, to the base 38 of the frame 22 in overlying relation to the first bar bottom support 150 by the fastener 170. The upper end of the second bar rack 210 is also supported by the frame 22. As best shown in FIG. 16, the second bar top support 234 is fixed to a respective side member 26 of the frame 22 by a pair of fasteners 270 extending through a respective slot 246 (not shown in FIG. 16) in the ends of the plate 238.

Figure 12:
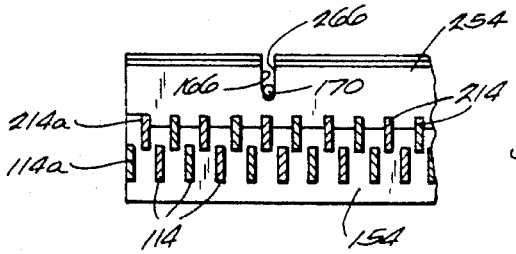
FIG. 12 is a cross-sectional view taken along line 12—12 in FIG. 7.
Figure 13:
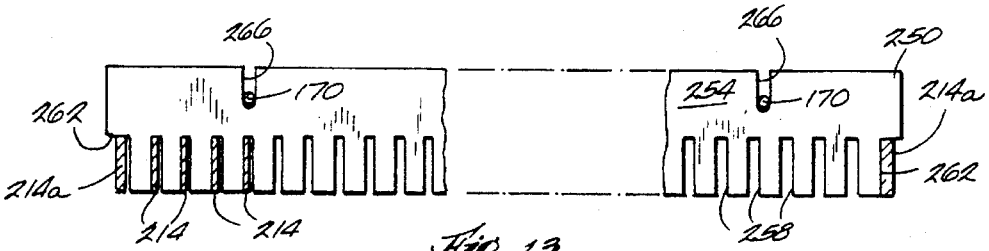
FIG. 13 is a view taken along line 13—13 in FIG. 8.

The second bar rack 210 is releasably mounted on the frame 22 of the bar screen 10 independent of the first bar rack 110. Referring to FIGS. 8 and 12, second bar bottom support 250 can be removed from the frame 22 of the bar screen 10 while leaving the first bar bottom support 150 in place by slightly loosening the fastener 170 and by sliding the second bar bottom support 250 in the direction of the slots 266 out of engagement with the fastener 170. The fastener 170 can then be tightened to secure the first bar rack 110 to the frame 22 of the bar screen 10. Also, with reference to FIG. 16, the upper portion of the second bar rack 210 can be disengaged from the frame 22 and from the first bar rack 110 by removing the fasteners 270 (one shown in FIG. 16) from each end 238 of the second bar top support 234 and from the side members 26.

Such releasable support of the second bar rack 210, which is independent of the support of the first bar rack 110, provides a fine screen compound bar rack 46 that can be installed as a retrofit to an existing bar screen having a single bar rack. Also, should flow conditions in the channel 18 undergo change requiring modification of the bar screen 10, the line screen compound bar rack 46 provides a flexible design to meet the changes in flow conditions. For example, should the bar screen 10 having the fine screen compound bar rack 46 be installed in a channel 18 according to the design specifications for an expected volumetric flow of wastewater, and if the actual volumetric flow of wastewater changes from the expected volumetric flow, then the second bar rack 210 could be removed from the bar screen 10 if so desired.

Conversely, if a bar screen 10 equipped with only a first bar rack 110 is used to screen a flow of wastewater, and changes in the flow dictate the use of a fine screen bar rack, the line screen compound bar rack 46 can be assembled by installing the second bar rack 210 downstream of the first bar rack 110. The second bar rack 210 can be installed by loosening the fastener 170 and sliding the bottom plate 254 under the loosened fastener 170. The fastener 170 can then be tightened to hold the first and second bar racks 110, 210 in place. The second bar rack 210 can be further fixed to the frame 22 of the bar screen 10 by drilling and tapping fastener holes in the side members 16 to align with the slots 146 in the second bar top support 138. Bolts 270 can then be installed to fix the second bar top support 138 to the frame 22. Accordingly, the bar screen 10 provides a fine screen compound bar rack 46 having a first effective screen opening defined by the spacing between the first bars 114 and the second bars 214 and means for alternatively enlarging or decreasing the effective screen opening of the bar rack 46 in response to the changes in flow conditions. The bar screen 10 thus also provides mounting means for fixing the first bar rack 110 to the frame 22 and for releasably mounting the second bar rack 210 on the frame 22.

Figure 11:
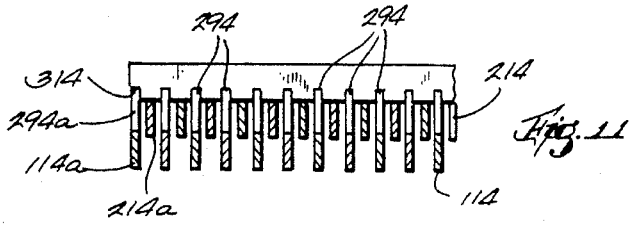
FIG. 11 is a cross-sectional view taken along line 11—11 in FIG. 7.

The fine screen compound bar rack 46 also includes (FIG. 8) means 290 for supporting the mid-portions of the first bars 114. The means 290 for supporting the mid-portions of the first bars 114 includes a plurality of generally trapezoidal sections 294 which extend rearwardly from the rearward faces 122 of the first bars 114. The sections 294 are arranged in an upper row 298 and a lower row 302. As best shown in FIG. 11, the trapezoidal sections 294 extend rearwardly between the second bars 214 and beyond the rearward faces 222 of the second bars 214.

The means 290 for supporting the mid-portions of the first bars 114 also includes (FIG. 8) upper and lower first bar intermediate supports 306, 310 that extend laterally across the width of the first bar rack 110 and that are located downstream of the second bar rack 210. The upper intermediate support 306 engages the rearward edges of the trapezoidal sections 294 in the upper row 298, and the lower intermediate support 310 engages the rearward edges of the trapezoidal sections 294 in the lower row 302. As best shown in FIG. 11, the upper first bar intermediate support 306 has therein a plurality of forwardly opening recesses 314 receiving respective trapezoidal sections 294. However, only the trapezoidal sections (identified by reference numeral 294*a*) extending from the outermost first bars 114*a* are fixed, preferably by welding, to upper first bar intermediate support 306. While not shown in detail, the lower first bar intermediate support 310 is similarly constructed and engages the lower row 302 of trapezoidal sections 294 in a like manner.

The fine screen compound bar rack 46 also includes (FIG. 8) means 318 for supporting the mid-portions of the second bars 214. In particular, the means 318 for supporting the midportions of the second bars 214 includes upper and lower second bar intermediate supports 322, 326 which extend laterally and which engage the rearward face 222 of each of the second bars 214. In particular, and referring to FIG. 10, the upper second bar intermediate supports 322 each has therein a plurality of forwardly opening recesses 330 receiving a portion of a respective second bar 214. However, the upper and lower second bar intermediate supports 322, 326 are fixed, as by welding, only to the outermost second bars 214a; the remainder of the second bars 214 are held in place by, and are slightly deflectable laterally within the recesses 330. While not shown in detail, the lower second bar intermediate supports 326 is constructed similar to the upper support 322 and engages the second bars 214 in a similar manner.

While the fine screen compound bar rack 46 is shown including means 290, 318 for supporting the mid-portions of the first bars 110 and the second bars 210, it should be recognized that such supporting means 290, 318 may be successfully omitted from the fine screen compound bar rack 46 in flow conditions not requiring such additional support of the first bars 110 and second bars 210.

Figure 3:
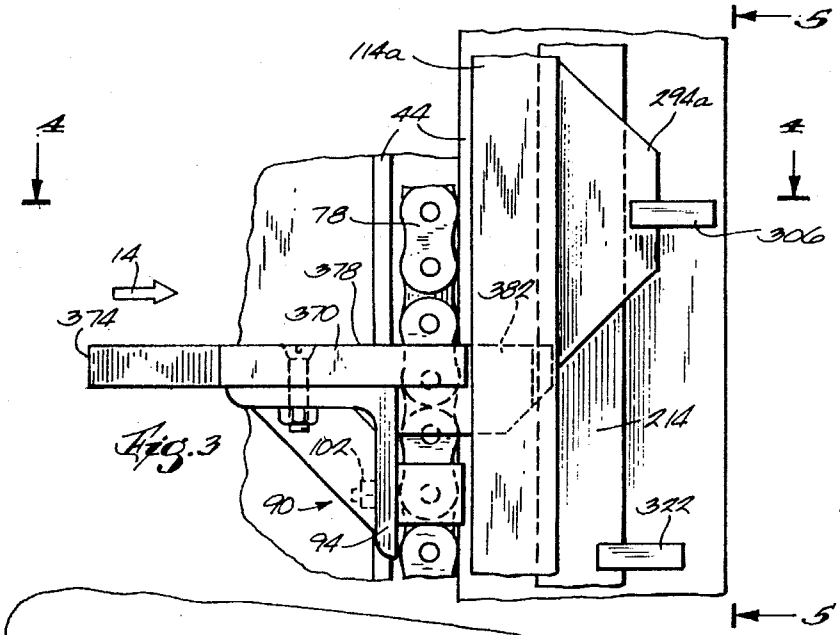
FIG. 3 is an enlarged view of a portion of the bar screen illustrated in FIG. 1.
Figure 4:
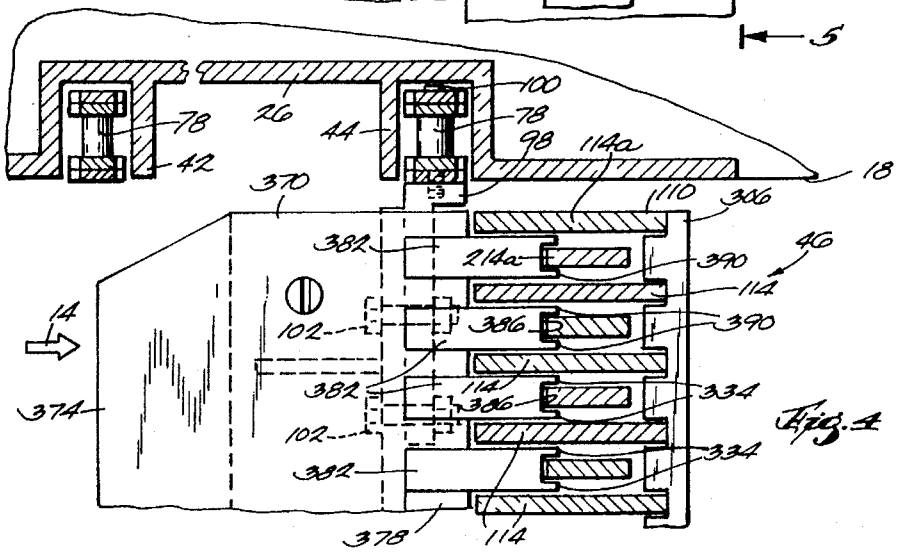
FIG. 4 is a cross-sectional view taken along line 4—4 in FIG. 3.

Referring now to FIGS. 3–5, the cleaning rake 50 is movable along the upstream face of the fine screen compound bar rack 46 to remove therefrom solids that have been screened from the flow 14 of wastewater. As shown particularly in FIG. 3, the cleaning rake 50 includes a base plate 370 which is bolted to the angle bracket 94 of the rake support 90. When the cleaning rake 50 moves along the fine screen compound bar rack 46, the base plate 370 has an upstream portion 374 that extends upstream of the rake support 90, and a downstream portion 378 that extends downstream of the rake support 90. The downstream portion 378 of the base plate 370 also extends (downwardly in FIGS. 3 and 5) between the rake support 90 and into closely spaced relation to the upstream faces 118 of the first bars 114. This extension of the base plate 370 between the rake support 90 and the fine screen compound bar rack 46 provides strength to the cleaning rake 50 to withstand stresses placed on the cleaning rake 50 as it moves along the fine screen compound bar rack 46 and as it removes collected solids.

As best shown in FIG. 4, a plurality of fingers 382 extend from the downstream portion 378 of the base plate 370 into meshed relation with the first bars 114 and second bars 214. The fingers 382 extend into the upstream spaces 134 defined by the first bars 114 and the end 386 of each finger 382 extends into closely spaced relation to an upstream face 218 of a second bar 214. Each of the fingers 382 has a width approximating the width of the upstream spaces 134 and each has a length approximately twice its width. Each finger 382 also has (FIGS. 4 and 5) a distal end 386 having a pair of spaced-apart prongs 390 which extend to either side of a second bar 214 and into a downstream space 334 between the first and second bars 114, 214. Each prong 390 has a width approximating the width of a downstream space 334, and each prong 390 has a length which is approximately 1.5 times its width.

As best shown in FIG. 3, the upper surface of each finger 382 is flush with the upper surface of the base plate 370. The extent of the ends of the prongs 390 and the ends 386 of the fingers 382 along the first and second bars 114, 214 is less than that of the downstream portion 378 of the base plate 370. However, the bottom surface of each finger 382 tapers (upwardly in FIG. 3) from slightly downstream of the downstream portion 378 the base plate 370 to the end of each prong 390 so that the height of each finger 382 diminishes approaching the distal end of the prongs 390.

The fingers 382 and prongs 390 are sufficiently wide to effectively remove solids from the upstream and downstream spaces 134, 334 and from the upstream faces 118, 218 of the first and second bars 114, 214 but preferably do not drag excessively along the first and second bars 114, 214. Also, the tapered thicknesses of the fingers 382 and prongs 390 provide supporting material to strengthen the fingers 382 and prongs 390 to withstand operational stresses of the bar screen 10 and to resist breakage.

The means 130, 230 which support the first bars 114 and the second bars 214, and which afford slight lateral deflection of the first bars 114 and second bars 214, also cooperate with the cleaning rake 50 to resist breakage of the fingers 382 and prongs 390. Should collected solids become lodged between the side faces 126, 226 of the first and second bars 114, 214 and the fingers 382 and prongs 390, the first and second bars 114, 214 tend to deflect laterally to allow the rake 50 to continue along the fine screen compound bar rack 46 rather than resisting the passage of rake 50 and possibly jamming or breaking the fingers 382 and prongs 390. By affording lateral deflection of the first and second bars 114, 214, the supporting means 130, 230 reduces breakage of the cleaning rake 50.

Figure 19:
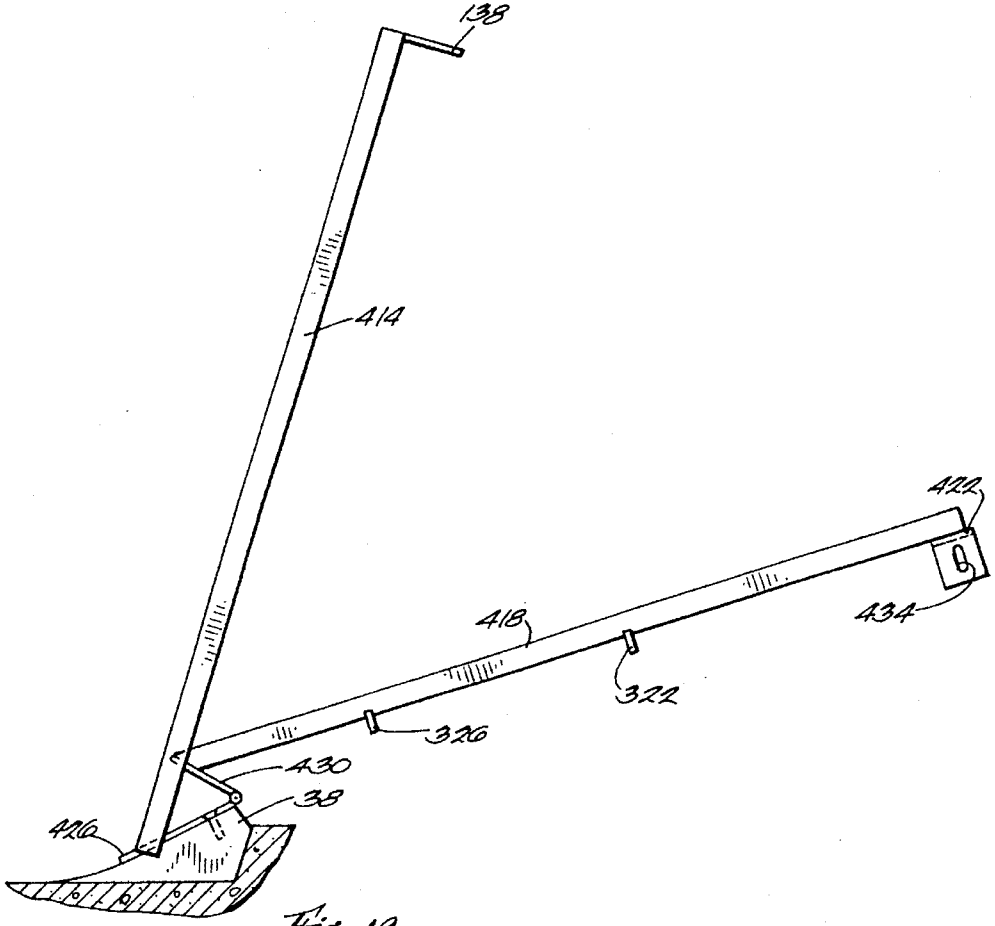
FIG. 19 is a view of the bar rack illustrated in FIG. 17 shown in a rearwardly pivoted position.
Figure 17:
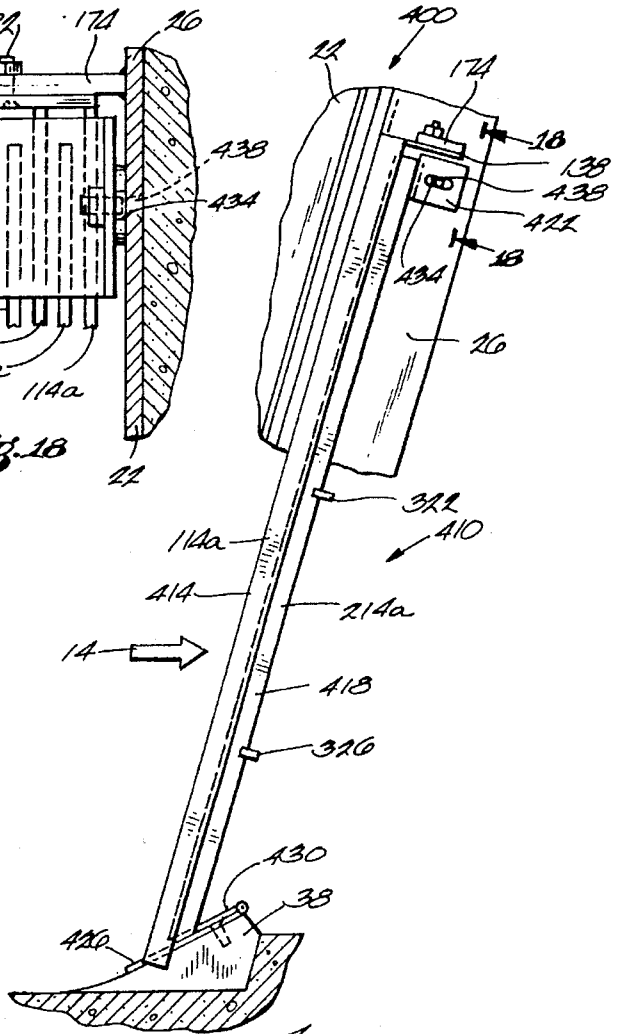
FIG. 17 is a side view of a portion of a bar screen which is an alternative embodiment of the invention.
Figure 18:
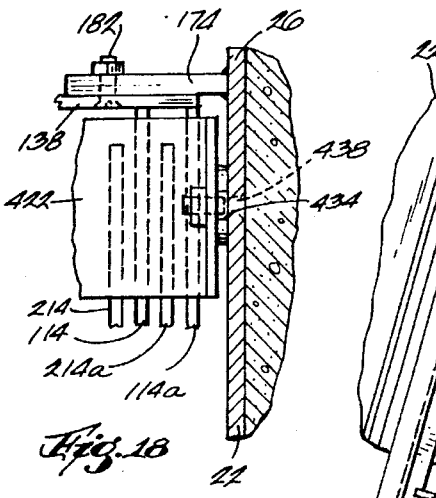
FIG. 18 is a view taken along line 18—18 in FIG. 17.

FIGS. 17–19 illustrate a bar screen 400 including a fine screen compound bar rack 410 which is an alternative embodiment of the invention. The fine screen compound bar rack 410 shown in FIGS. 17–19 is substantially similar to the fine screen compound bar rack 46 shown in FIGS. 1–16, and common features are identified with common reference numerals.

The fine screen compound bar rack 410 includes (FIG. 17) first and second bar racks 414, 418 including respective first bars 114 and second bars 214. Also, the first and second bar racks 414, 418 respectively include a first bar top support 138 and a second bar top support 422. The opposite ends of second bar top support 422 extend rearwardly and have therein a single slot 434. The fine screen compound bar rack 410 also includes a first bar bottom support 426, which is bolted to the base 38 of the frame 22, and a second bar bottom support 430, which normally overlies a portion of the first bar bottom support 426. The second bar bottom support 430 is hingedly connected to the first bar bottom support 426 along the rearward edges thereof. The hinged connection between the first bar bottom support 426 and the second bar bottom support 430 affords rearward pivotal movement of the second bar rack 418 relative to the first bar rack 414 between (FIG. 17) a first generally upright position and (FIG. 19) a second, rearwardly pivoted position.

In order to afford such pivotal movement of the second bar rack 418 relative to the first bar rack 414, the fine screen compound bar rack 410 shown in FIGS. 17–19 does not include laterally extending mid-portion support members which are fixed to the first bar rack 110 or which are located behind the second bars 214. However, the fine screen compound bar rack 410 does include (FIGS. 17 and 19) upper and lower second bar intermediate supports 322, 326 which engage and support the mid-portions of the second bars 214.

Referring particularly to FIG. 18, the fine screen compound bar rack 410 also includes a releasable connection between the second bar top support 422 and the frame 22. Various suitable arrangements can used to provide the releasable connection between the second bar rack top support 422 and the frame 22. For example, a spring-loaded release or latch could provide such a connection. In the illustrated embodiment, the releasable connection between the frame 22 and the second bar rack 418 is made by a pair of shear pins 438 (one shown in FIG. 18) extending from a side member 26 of the frame 22 through a slot 434 in the second bar top support 422. Unlike the bolt 270 (shown in FIG. 16) used to fix the second bar rack 210 of the fine screen compound bar rack 46, the releasable connection (FIG. 18) between the second bar top support 234 and the side member 26 does not necessarily require removal of the fastener. Rather, the provision of a shear pin 438 to connect the second bar top support 422 and the second bar rack 418 affords automatic rearward pivotal movement of the second bar rack 418 when pressure exerted on the compound bar rack 410 by the flow 14 of wastewater exceeds a threshold pressure.

In particular, during normal operation of the bar screen 400, the second bar rack 418 of the fine screen compound bar rack 410 is in the first, generally upright position, and the flow 14 of wastewater creates rearwardly directed forces against the fine screen compound bar rack 410. When the pressure against the fine screen compound bar rack 410, or the head loss across the fine screen compound bar rack 410, becomes excessive, the forces acting against the second bar top support 422 and the pin 438 shear the shank of the pin 438, thereby releasing the support of the upper portion of the second bar rack 418. When the upper portion of the second bar rack 418 is so released, the second bar rack 418 pivots rearwardly about the hinge away from the first bar rack 110. As a result, the effective screen opening of the fine screen compound bar rack 46 is increased because of the retraction of the second bars 214 from the upstream spaces between the first bars 114. The first bar rack 110 is then the sole effective screen of the flow 14 of wastewater. Thereafter, the flow 14 through the compound bar rack can increase, and the pressure exerted against the bar rack should decrease. The bar screen 400 thus also provides means for enlarging the effective screen opening of the fine screen compound bar rack in response to the changes in flow conditions.

Thereafter, once the flow of wastewater through the bar screen 400 subsides to normal levels of flow, the second bar rack 418 can be reset by pivoting the second bar rack 418 upwardly toward its vertical position in closely spaced relation to the first bar rack 110. The releasable connection between the side member 26 and the second bar rack 418 can then be reestablished.

Various other features of the invention are set forth in the following claims:

We claim:

1. A bar screen for screening a flow of wastewater, the bar screen comprising a frame, a first bar rack extending across the flow of wastewater, the first bar rack including a plurality of generally parallel, elongated first bars each having a top end and a bottom end, the plurality of first bars defining therebetween a plurality of upstream spaces, a second bar rack extending across the flow of wastewater, the second bar rack including a plurality of generally parallel, elongated second bars each having a top end and a bottom end, and mounting means for fixing the first bar rack to the frame and for releasably mounting the second bar rack on the frame, the mounting means including a laterally extending first plate fixed to the first bars, a laterally extending second plate fixed to the second bars and overlapping a portion of the first plate, and a fastener fixing the first plate to the frame, the first and second bar racks thereby defining a fine screen compound bar rack wherein the second bars have a portion aligning with a respective upstream space.

2. A bar screen as set forth in claim 1 wherein the first bar rack includes a first bar rack top support engaged with the top end of each first bar and a first bar rack bottom support engaged with the bottom end of each first bar, wherein the second bar rack includes a second bar rack top support engaged with the top end of each second bar and a second bar rack bottom support engaged with the bottom end of each second bar, the second bar rack bottom support overlying a portion of the first bar rack bottom support and being hingedly connected to the first bar bottom support.

3. A bar screen as set forth in claim 1 wherein the first bar rack includes a first bar rack top support engaged with the top end of each first bar and a first bar rack bottom support engaged with the bottom end of each first bar, wherein the second bar rack includes a second bar rack top support engaged with the top end of each second bar and a second bar rack bottom support engaged with the bottom end of each second bar, the second bar rack bottom support overlying a portion of the first bar rack bottom support, and wherein the means for releasably mounting the second bar rack on the frame alternatively affords installation and removal of the second bar rack independent of the first bar rack.

4. A bar screen as set forth in claim 1 wherein the second bar rack is movable relative to the first bar rack in response to excessive pressure on the second bar rack by the flow of wastewater.

5. A bar screen as set forth in claim 1 and further including a cleaning rake which is movable along the first bars and the second bars and which includes a plurality of fingers which extend into the upstream spaces.

6. A bar screen as set forth in claim 5 wherein the each second bar has a pair of opposite side faces, and wherein the fingers of the cleaning rake have ends extending in closely spaced relation to opposite faces of the second bars.

7. A bar screen as set forth in claim 1 wherein each of the second bars has a mid-portion extending between the top end and the bottom end, and wherein the second bar rack includes means for supporting the mid-portions of the second bars.

8. A bar screen as set forth in claim 7 wherein each first bar has a mid-portion extending between the top end and the bottom end, and wherein the first bar rack includes means for supporting the mid-portions of the first bars.

9. A bar screen as set forth in claim 1 wherein the first bars and the second bars are slightly deflectable laterally with respect to the direction of flow.

10. A bar screen for screening a flow of wastewater, the bar screen comprising a frame, a first bar rack including a plurality of generally parallel, elongated first bars defining therebetween a plurality of upstream spaces, a second bar rack including a plurality of generally parallel, elongated second bars, means for fixing the first bar rack to the frame, means for mounting the second bar rack on the frame to provide a compound fine screen bar rack extending into the flow of wastewater and having an effective screen opening, and means for enlarging the effective screen opening in response to changes in flow conditions wherein the means for enlarging the effective screen opening of the compound fine screen bar rack includes a releasable connection between the second bar rack and the frame, and wherein the releasable connection automatically disconnects when the flow of wastewater exerts a pressure on the fine screen compound bar rack exceeding a threshold pressure.

11. A bar screen as set forth in claim 10 wherein means for mounting the second bar rack supports the second bar rack in closely spaced relation to the first bar rack, and wherein the means for enlarging the effective screen opening affords movement of the second bar rack out of closely spaced relation to the first bar rack.

12. A bar screen as set forth in claim 10 and further including a cleaning rake movable along the first bars and the second bars.

13. A bar screen as set forth in claim 10 wherein the second bars each have a mid-portion, and wherein the second bar rack includes means for supporting the mid-portions of the second bar rack.

14. A bar screen for screening a flow of wastewater, the bar screen comprising, a frame, a first bar rack supported by the frame and extending across the flow of wastewater, the first bar rack including a plurality of generally parallel, straight and elongated first bars, the first bars being uniformly spaced apart to define therebetween a plurality of upstream spaces, a second bar rack supported by the frame and extending across the flow of wastewater immediately adjacent and downstream of the first bar rack, cite second bar rack including a plurality of generally parallel, straight and elongated second bars, the second bars being uniformly spaced apart, each of the second bars having an upstream face aligning with a respective upstream space to define with the first bars an alternating array of first bars and second bars, and a cleaning rake movable along the first bar rack and the second bar rack for cleaning the first bar rack and the second bar rack, the cleaning rake including a plurality of fingers, each finger extending into a respective upstream space and having a distal end including a pair of prongs, each prong extending past the upstream face of a second bar.

15. A bar screen as set forth in claim 14 wherein the first bars and the second bars are supported for slight lateral displacement with respect to the flow of wastewater.

16. A bar screen as set forth in claim 15 wherein each second bar includes a top end, a bottom end and a mid-portion between the top end and bottom end, and wherein the second bar rack includes an intermediate support engaged with the mid-portions portions of the second bars, the intermediate support having therein slots receiving a portion of the second bars.

17. A bar screen as set forth in claim 16 wherein the second bars are supported in a row across the flow of wastewater so that a pair of outermost second bars are located at opposite ends of the row of second bars, and wherein the intermediate support is fixed only to the outermost second bars.

18. A bar screen as set forth in claim 17 wherein the plurality of first bars each have a pair of opposite facing side faces that are mutually parallel and that are generally parallel to the direction of flow of wastewater.

19. A bar screen as set forth in claim 14 wherein each of the second bars have a portion extending into a respective upstream space and define, with the first bars, a plurality of downstream spaces, the downstream spaces each having a width, and wherein each prong has a width approximating the width of the downstream spaces.

20. A bar screen as set forth in claim 14 wherein each finger has a length extending into an upstream space and has a width, and wherein the length of each finger is approximately twice the width of the finger.

21. A bar screen for screening a flow of wastewater, the bar screen comprising, a frame, a plurality of generally parallel, elongated first bars, the plurality of first bars defining therebetween a plurality of upstream spaces, each first bar having a respective upstream face, a plurality of generally parallel, elongated second bars arranged to register with the upstream spaces, a portion of each second bars extending into an upstream space and defining, with the associated first bars, a plurality of downstream spaces, a cleaning rake movable along the upstream faces of the first bars and along the second bars for cleaning the upstream spaces and the downstream spaces, and mounting means for fixing the first bars to the frame and for mounting the second bars on the frame, the mounting means including support members located downstream of the first bars and the second bars for supporting the first and second bars and for affording lateral displacement of the first bars and the second bars to prevent breakage of the fingers as the rake moves along the first bars and the second bars.

22. A bar screen as set forth in claim 21 wherein the mounting means affords removal of the second bars from the frame independent of the first bars.

23. A bar screen as set forth in claim 21 wherein the second bars are hingedly connected to the frame and the first bars.

24. A bar screen as set forth in claim 21 and further including a first bar bottom support engaged with each of the first bars, a second bar bottom support engaged with each of the second bars, and wherein the second bar bottom support overlies the first bar bottom support.

25. A bar screen for screening a flow of wastewater, the bar screen comprising a frame, a first bar rack including a plurality of generally parallel, elongated first bars defining therebetween a plurality of upstream spaces, a second bar rack including a plurality of generally parallel, elongated second bars, means for fixing the first bar rack to the frame, means for mounting the second bar rack on the frame to provide a compound fine screen bar rack extending into the flow of waste water and having an effective screen opening, and means for enlarging the effective screen opening in response to changes in flow conditions wherein the means for mounting the second bar rack affords rearward pivotal movement of the second bar rack relative to the first bar rack.

26. A bar screen as set forth in claim 25 wherein the second bar rack is hingedly connected to the frame.

27. A bar screen as set forth in claim 26 wherein the second bar rack is hingedly connected at its lower end to the frame, and wherein the upper end of the second bar rack is connected to the frame by a releasable connection.

* * * * *